US011680409B2

(12) United States Patent
Boss et al.

(10) Patent No.: US 11,680,409 B2
(45) Date of Patent: Jun. 20, 2023

(54) ROOFING MATERIALS WITH SYNTHETIC ROOFING GRANULES AND METHODS OF MAKING THEREOF

(71) Applicant: BMIC LLC, Dallas, TX (US)

(72) Inventors: Daniel E. Boss, Morris Township, NJ (US); Ming Shiao, Basking Ridge, NJ (US); Luis Duque, Hackensack, NJ (US)

(73) Assignee: BMIC LLC, Dallas, TX (US)

( * ) Notice: Subject to any disclaimer, the term of this patent is extended or adjusted under 35 U.S.C. 154(b) by 0 days.

(21) Appl. No.: 17/696,007

(22) Filed: Mar. 16, 2022

(65) Prior Publication Data

US 2022/0298793 A1 Sep. 22, 2022

Related U.S. Application Data

(60) Provisional application No. 63/161,483, filed on Mar. 16, 2021.

(51) Int. Cl.

| | |
|---|---|
| ***E04D 1/20*** | (2006.01) |
| *E04D 1/26* | (2006.01) |
| *E04D 1/00* | (2006.01) |

(52) U.S. Cl.
CPC ..... *E04D 1/20* (2013.01); *E04D 1/26* (2013.01); *E04D 2001/005* (2013.01)

(58) Field of Classification Search
CPC ..... E04D 1/20; E04D 1/26; E04D 2001/005
See application file for complete search history.

(56) References Cited

U.S. PATENT DOCUMENTS

| | | | | |
|---|---|---|---|---|
| 7,354,596 | B1 | 4/2008 | Banovetz et al. | |
| 8,673,427 | B2 * | 3/2014 | Kalkanoglu | E04D 1/20 428/40.1 |
| 8,997,427 | B2 * | 4/2015 | Kalkanoglu | E04D 1/20 428/141 |
| 9,057,194 | B2 * | 6/2015 | Jenkins | E04D 1/28 |
| 9,074,373 | B2 * | 7/2015 | Stahl | E04D 11/02 |
| 9,404,259 | B2 | 8/2016 | Heulings et al. | |
| 9,538,762 | B2 | 1/2017 | Bryson et al. | |
| 10,584,493 | B2 * | 3/2020 | Jenkins | E04D 1/12 |
| 11,414,342 | B2 | 8/2022 | Budd et al. | |
| 2005/0072114 | A1 | 4/2005 | Shiao et al. | |
| 2007/0148342 | A1 | 6/2007 | Kalkanoglu et al. | |
| 2013/0095293 | A1 * | 4/2013 | Boss | B32B 38/08 442/64 |
| 2013/0202852 | A1 * | 8/2013 | Shiao | E04D 5/12 428/150 |
| 2014/0349072 | A1 * | 11/2014 | Hong | E04D 13/00 428/147 |
| 2019/0185681 | A1 | 6/2019 | Anderson et al. | |
| 2019/0300449 | A1 | 10/2019 | Panzarella et al. | |

* cited by examiner

*Primary Examiner* — Adriana Figueroa
(74) *Attorney, Agent, or Firm* — Venable LLP

(57) ABSTRACT

This invention, in embodiments, relates to a roofing material comprising (a) a coated substrate having a top surface and a back surface, and (b) a plurality of roofing granules applied to the top surface of the coated substrate. The plurality of roofing granules comprises from 50% to 100% of unitary, uncoated, non-mineral based particles. This invention, in embodiments, further relates to a method of preparing such roofing material.

20 Claims, 5 Drawing Sheets

| Type | Color | CIELAB Color Space | | | | Avg. Total Solar Reflectance |
|---|---|---|---|---|---|---|
| | | L* | a* | b* | E* | |
| Mineral-Based Granules | Gray Green | 44.6 | -2.6 | 3.0 | 44.8 | 0.2 |
| | Green | 32.3 | -13.4 | 9.9 | 36.3 | 0.1 |
| | Red | 30.3 | 18.2 | 15.6 | 38.7 | 0.1 |
| | Dark Black | 17.2 | 0.2 | 0.4 | 17.2 | 0.1 |
| | Light Black | 27.2 | -0.4 | -0.2 | 27.2 | 0.1 |
| | Black | 29.9 | -0.6 | -0.3 | 29.9 | 0.1 |
| | Cinnamon | 35.3 | 15.8 | 18.8 | 43.0 | 0.2 |
| | Brown | 23.2 | 6.2 | 5.7 | 24.6 | 0.1 |
| | Desert Tan | 46.4 | 6.5 | 11.2 | 48.2 | 0.2 |
| | Buff | 56.5 | 8.6 | 21.3 | 61.0 | 0.3 |
| | White | 76.9 | -0.1 | 2.1 | 77.0 | 0.5 |
| | Off-White | 61.5 | -0.1 | 0.7 | 61.5 | 0.3 |
| | Gray | 48.0 | -1.0 | -1.9 | 48.1 | 0.2 |
| Synthetic Granules | Black n Grain | 17.2 | 0.1 | 0.1 | 17.2 | 0.1 |
| | Charcoal Gray | 32.9 | 0.4 | 1.1 | 32.9 | 0.2 |
| | Cool Gray | 31.9 | -0.6 | -2.8 | 32.0 | 0.3 |
| | Dark Bronze | 28.9 | 0.1 | -0.9 | 28.9 | 0.2 |
| | Dark Brown | 30.3 | 1.0 | 1.0 | 30.3 | 0.2 |
| | Dark Grey | 26.7 | 1.2 | 1.2 | 26.8 | 0.2 |
| | Desert Tan | 35.2 | 2.0 | 2.9 | 35.4 | 0.3 |
| | Energy Tan | 43.4 | 3.8 | 12.3 | 45.3 | 0.4 |
| | Goldenrod | 53.1 | 9.8 | 30.0 | 61.7 | 0.5 |
| | Hartford Green | 47.7 | 6.9 | 27.4 | 55.4 | 0.2 |
| | Ivy Green | 43.1 | 1.1 | 16.6 | 46.2 | 0.2 |
| | Patina Green | 35.8 | -7.9 | 3.3 | 36.8 | 0.2 |
| | Regal Blue | 34.8 | -5.4 | 1.3 | 35.2 | 0.2 |
| | Regal Red | 33.9 | 6.7 | 6.9 | 35.2 | 0.3 |
| | RV Almond | 51.0 | 10.3 | 9.9 | 53.0 | 0.7 |
| | RV Beige | 51.7 | 11.5 | 15.7 | 55.3 | 0.2 |
| | RV Gray | 62.5 | 0.2 | 8.9 | 63.2 | 0.5 |
| | Smoke Gray | 50.1 | -0.8 | -1.3 | 50.1 | 0.3 |
| | Terra Cotta | 38.6 | 4.3 | 3.3 | 38.9 | 0.3 |
| | White 299 | 95.0 | -0.7 | 3.9 | 95.1 | 0.8 |

FIG. 2

| Sample | Granule Type | Color | Particle Shape | Particle Geometry (LxWxH) (in.) | CIELab Color Space | | | | Avg. Total Solar Reflectance (%) | Shingle Wt./Thickness/Area (g/mil/ft$^2$) |
|---|---|---|---|---|---|---|---|---|---|---|
| | | | | | L* | a* | b* | E* | | |
| 1 | Mineral-Based | Gray Green | Cubical | 0.04x0.04x0.04 | 44.1 | -3.5 | 2.2 | 44.3 | 12.2% | 2.6 |
| 2 | Mineral-Based | Brown | Cubical | 0.06x0.06x0.06 | 24.3 | 6.1 | 7.5 | 26.2 | 4.7% | 2.5 |
| 3 | Mineral-Based | White | Cubical | 0.05x0.05x0.06 | 64.7 | -1.2 | 0.6 | 64.7 | 31.8% | 2.3 |
| 4 | Non Mineral-Based | Hartford Green | Rod | 0.13x0.07 | 35.3 | -8.3 | -5.7 | 36.7 | 18.8% | 1.5 |
| 5 | Non Mineral-Based | Dark Brown | Rod | 0.13x0.06 | 23.5 | 3.1 | 3.6 | 24.0 | 16.6% | 1.9 |
| 6 | Non Mineral-Based | White 299 | Spherical | 0.1x0.1 | 85.6 | -0.6 | 2.3 | 85.6 | 64.7% | 1.8 |

FIG. 4

| Sample | Granule Type | Color | CIELab Color Measurement | | | Staining Index (ΔE*) |
|---|---|---|---|---|---|---|
| | | | L* | a* | b* | |
| 1 (initial) | Mineral-Based | I-760 | 49.7 | -2.4 | -1.5 | 3.3 |
| 1 (after) | | | 47.3 | -1.6 | 0.6 | |
| 2 (initial) | Non Mineral-Based | RV Grey | 60.8 | -4.7 | -1.3 | 0.4 |
| 2 (after) | | | 60.5 | -4.6 | -1.2 | |

ROOFING MATERIALS WITH SYNTHETIC ROOFING GRANULES AND METHODS OF MAKING THEREOF

RELATED APPLICATION

This application claims the priority of U.S. provisional application Ser. No. 63/161,483, entitled "Roofing Materials With Synthetic Roofing Granules And Methods of Making Thereof" filed Mar. 16, 2021, which is incorporated herein by reference in its entirety for all purposes.

FIELD OF THE INVENTION

This invention relates to roofing materials having synthetic roofing granules and methods of making these roofing materials. By preparing roofing materials such as, e.g., shingles, using synthetic or non-mineral based roofing granules, these roofing materials can exhibit superior properties of, for example, reduced weight, improved or higher solar reflectance, reduced staining, improved color saturation and/or gloss, as compared to roofing materials having traditional, mineral-based roofing granules.

BACKGROUND OF THE INVENTION

Traditional roofing materials, such as, e.g., shingles, are based upon a glass or felt mat that is coated and impregnated with an asphalt-based composition that is coated with granules. These granules, which are typically mineral-based particles, are applied to the surface of the shingles to protect the shingle, while also providing additional coloring and/or textures to thus, enhance the aesthetics of the shingle. Generally, the mineral-based particles are mined from rock that is dense, which results in a significant increase in the weight of the shingle. Additionally, the mineral-based particles are typically dark in color for the necessary UV opacity to protect the asphaltic materials of the shingle from degradation over time, while also having a rough surface as a result of crushing the material to size. As a result, these dark-color, rough granules have a tendency to absorb high levels of solar radiation, while the rough surfaces decrease reflectivity of the granules. This absorption of high levels of solar radiation, as well as the decreased reflectivity of the granules can result in a "hot roof," which can lead to an increase in the cooling energy needed to keep the indoor air comfortable during summer seasons.

As discussed above, roofing granules comprising mineral-based particles can significantly increase the weight of the shingle, such that the shingles become heavy to handle and/or the design of multiple layers of shingles is limited due to the heavy weight of the final shingle product. Also, the mineral-based roofing granules have a tendency to absorb oils from the asphalt of the shingles, which results in an undesirable "stained" or "darkened" color of the shingle.

There is thus a need for synthetic or non-mineral based roofing granules for preparing roofing materials that exhibit reduced weight, improved solar reflectance, reduced staining, improved color and/or gloss, as compared to roofing materials having traditional, mineral-based roofing granules.

SUMMARY OF THE INVENTION

One embodiment of this invention pertains to a roofing material comprising (a) a coated substrate having a top surface and a back surface, and (b) a plurality of roofing granules applied to the top surface of the coated substrate.

The plurality of roofing granules comprises from 50% to 100% of unitary, uncoated, non-mineral based particles.

In one embodiment, the substrate comprises one of a fiberglass mat, a polyester mat, a scrim, a coated scrim, or a combination thereof.

In one embodiment, the roofing material is one of a roofing shingle and a roofing tile.

In one embodiment, the roofing material is one of (i) an asphaltic shingle, (ii) a non-asphaltic shingle, and (ii) a polymer-modified asphalt shingle.

In some embodiments, each roofing granule of the plurality of roofing granules has a density of 1.2 g/cm$^3$ to 2.5 g/cm$^3$.

In one embodiment, the non-mineral based particles comprise a synthetic particle.

In one embodiment, the non-mineral based particles comprise at least one of a thermoplastic polymer, filled polymers, filled rubbers, filled plastics, a polymer-sand composite, a rubber particle, a recycled material, a wood filled polymer, a bio-based particle, a thermoset material, a fiber-reinforced polymer, and combinations thereof.

In one embodiment, the non-mineral based particles have an aspect ratio of from 1.5 to 50. In another embodiment, the non-mineral based particles have an aspect ratio of from 5 to 30.

In one embodiment, the non-mineral based particles have a particle size of #8 US mesh to #60 US mesh.

In one embodiment, less than 1% by weight of the plurality of roofing granules have a particle size of greater than #100 US mesh.

In an embodiment, the roofing material exhibits a lower weight per thickness as compared to a roofing material prepared with roofing granules comprising a majority of mineral based particles.

In one embodiment, the roofing material exhibits a weight per thickness of 1 to 3 g/mil/ft$^2$.

In one embodiment, the roofing material exhibits an improved staining resistance as compared to a roofing material prepared with roofing granules comprising a majority of mineral based particles.

In an embodiment, the roofing granules exhibit a total solar reflectance (TSR) of 0.2 to 0.8 according to ASTM C1549.

In one embodiment, the roofing granules exhibit a higher color saturation as compared to roofing granules comprising mineral based particles.

Another embodiment of this invention pertains to a method of preparing a roofing material. The method includes (a) obtaining a coated substrate, (b) obtaining a plurality of roofing granules, wherein the plurality of roofing granules comprises from 50% to 100% of unitary, uncoated, non-mineral based particles, and (c) applying the plurality of roofing granules to a surface of the coated substrate to form a roofing material.

In one embodiment, the step of applying the plurality of roofing granules to the surface of the coated substrate is conducted to achieve an average surface coverage amount of the roofing granules of greater than 80%.

In one embodiment, the substrate comprises one of a fiberglass mat, a polyester mat, a scrim, a coated scrim, or a combination thereof.

In some embodiments, the roofing material is one of a roofing shingle and a roofing tile.

In some embodiments, each roofing granule of the plurality of roofing granules has a density of 1.2 g/cm$^3$ to 2.5 g/cm$^3$.

In one embodiment, the non-mineral based particles comprise a synthetic particle.

In one embodiment, the non-mineral based particles comprise at least one of a thermoplastic polymer, filled polymers, filled rubbers, filled plastics, a polymer-sand composite, a rubber particle, a recycled material, a wood filled polymer, a bio-based particle, a thermoset material, a fiber-reinforced polymer, and combinations thereof.

BRIEF DESCRIPTION OF THE FIGURES

For a more complete understanding of the invention and the advantages thereof, reference is made to the following descriptions, taken in conjunction with the accompanying figures, in which:

FIG. 2 is a table illustrating color space values and TSR values of mineral-based roofing granules as compared to synthetic or non-mineral based roofing granules according to embodiments of the invention.

FIG. 4 is a table illustrating color space values, TSR values, and other measurements of mineral-based roofing granules as compared to synthetic or non-mineral based roofing granules according to embodiments of the invention.

DETAILED DESCRIPTION OF THE INVENTION

Figure 1:
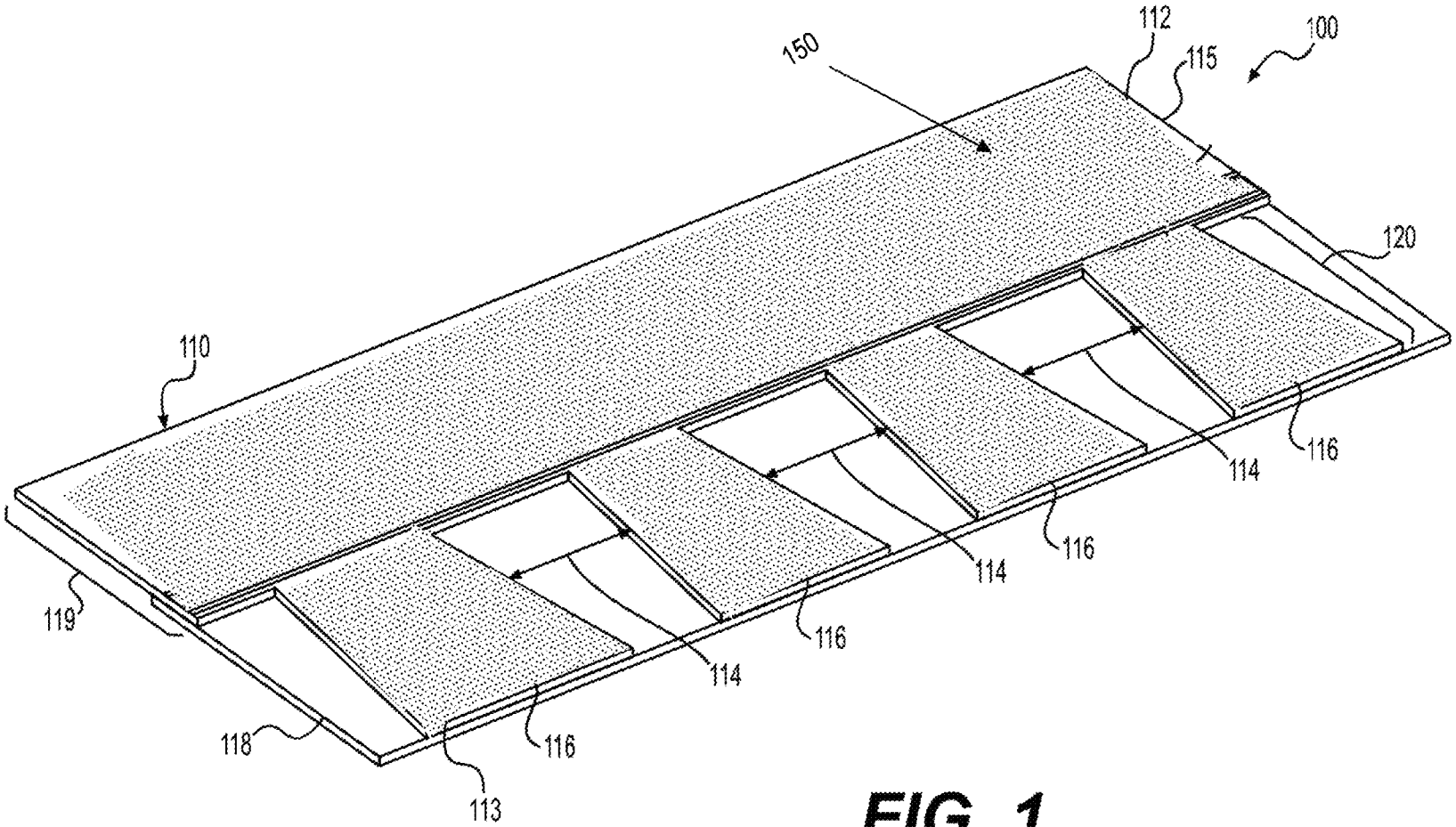
FIG. 1 is an illustration of a roofing material comprising synthetic or non-mineral based roofing granules according to an embodiment of the invention.

Among those benefits and improvements that have been disclosed, other objects and advantages of this disclosure will become apparent from the following description taken in conjunction with the accompanying figures. Detailed embodiments of the present disclosure are disclosed herein; however, it is to be understood that the disclosed embodiments are merely illustrative of the disclosure that may be embodied in various forms. In addition, each of the examples given regarding the various embodiments of the disclosure are intended to be illustrative, and not restrictive.

Throughout the specification and claims, the following terms take the meanings explicitly associated herein, unless the context clearly dictates otherwise. The phrases "in one embodiment," "in an embodiment," and "in some embodiments" as used herein do not necessarily refer to the same embodiment(s), though they may. Furthermore, the phrases "in another embodiment" and "in some other embodiments" as used herein do not necessarily refer to a different embodiment, although they may. All embodiments of the disclosure are intended to be combinable without departing from the scope or spirit of the disclosure.

As used herein, the term "based on" is not exclusive and allows for being based on additional factors not described, unless the context clearly dictates otherwise. In addition, throughout the specification, the meaning of "a," "an," and "the" include plural references. The meaning of "in" includes "in" and "on."

As used herein, terms such as "comprising," "including," and "having" do not limit the scope of a specific claim to the materials or steps recited by the claim.

As used herein, terms such as "consisting of" and "composed of" limit the scope of a specific claim to the materials and steps recited by the claim.

All prior patents, publications, and test methods referenced herein are incorporated by reference in their entireties.

As used herein, the term "coated substrate" means a substrate that is coated on one side (upper surface or lower surface) or both sides (upper surface and lower surface) with a coating that includes, for example, an asphaltic coating, a non-asphaltic coating, and/or a polymer-modified asphalt coating. According to one embodiment, the "coated substrate" can also include a modified bitumen roll(s), a roll(s) of non-asphaltic roofing, metal shingles and/or tiles, and any other roofing tiles or elements where a granulated surface is desired.

As used herein, the term "weight percent" or "% by weight" means the percentage by weight of the roofing granules based upon a total weight of the roofing granules applied to the roofing material.

As used herein, the term "a majority of" means greater than 50% by weight.

As used herein, the term "roofing material" includes, but is not limited to, shingles, waterproofing membranes, underlayment, and tiles.

One embodiment of this invention pertains to a roofing material comprising (a) a coated substrate having a top surface and a back surface, and (b) a plurality of roofing granules applied to the top surface of the coated substrate. The plurality of roofing granules comprises from 50% to 100% of unitary, uncoated, non-mineral based particles.

FIG. 1 illustrates a roofing material (e.g., shingle) 100 according to an embodiment of the invention. In this embodiment, the roofing material 100 includes a coated substrate 110 having a front or top surface 112 and a back surface 115. The roofing material 100 further includes an upper portion or headlap portion 119 and a lower portion or buttlap portion 120. The buttlap portion 120 includes a series of cut-outs 114 leaving a plurality of tabs 116. The edge 113 of the buttlap portion 120 will be the lowermost or bottom edge of the roofing material 100 when installed onto a roof. Attached and/or laminated to the back surface 115 of the roofing material 100 is a backer strip 118. As shown in FIG. 1, the upper surface of the backer strip 118 is visible between the tabs 116 of the buttlap portion 120 of the coated substrate 110 of the roofing material 100.

The roofing material 100 of the embodiment of FIG. 1 further includes a plurality of roofing granules 150 disposed on the top surface 112 of the headlap portion 119, the plurality of tabs 116, and the backer strip 118. In an embodiment, the plurality of roofing granules comprises from 50% to 100% of unitary, uncoated, non-mineral based particles. In an embodiment, the plurality of roofing granules comprises from 60% to 100% of unitary, uncoated, non-mineral based particles. In an embodiment, the plurality of roofing granules comprises from 70% to 100% of unitary, uncoated, non-mineral based particles. In an embodiment, the plurality of roofing granules comprises from 75% to 100% of unitary, uncoated, non-mineral based particles. In an embodiment, the plurality of roofing granules comprises from 80% to 100% of unitary, uncoated, non-mineral based particles. In an embodiment, the plurality of roofing granules comprises from 85% to 100% of unitary, uncoated, non-mineral based particles. In an embodiment, the plurality of roofing granules comprises from 90% to 100% of unitary, uncoated, non-mineral based particles. In an embodiment, the plurality of roofing granules comprises from 95% to 100% of unitary, uncoated, non-mineral based particles. In an embodiment, the plurality of roofing granules comprises from 50% to 90% of unitary, uncoated, non-mineral based particles. In an embodiment, the plurality of roofing granules comprises from 60% to 90% of unitary, uncoated, non-mineral based particles. In an embodiment, the plurality of roofing granules comprises from 70% to 90% of unitary, uncoated, non-mineral based particles. In an embodiment, the plurality of roofing granules comprises from 80% to 90% of unitary, uncoated, non-mineral based particles. In an embodiment, the plurality of roofing granules comprises from 50% to 80% of unitary, uncoated, non-mineral based particles. In an embodiment, the plurality of roofing granules comprises from 60% to 80% of unitary, uncoated, non-mineral based particles. In an embodiment, the plurality of roofing granules comprises from 70% to 80% of unitary, uncoated, non-mineral based particles. In an embodiment, the plurality of roofing granules comprises from 50% to 70% of unitary, uncoated, non-mineral based particles. In an embodiment, the plurality of roofing granules comprises from 60% to 70% of unitary, uncoated, non-mineral based particles. In an embodiment, the plurality of roofing granules comprises from 50% to 60% of unitary, uncoated, non-mineral based particles.

In an embodiment, the substrate (e.g., coated substrate 110) comprises one of a fiberglass mat, a polyester mat, a scrim, a coated scrim, or a combination thereof. In some embodiments, the substrate or mat includes nano-fibrillated cellulose fibers.

In an embodiment, the roofing material (e.g., roofing material 100) is one of a roofing shingle and a roofing tile. In some embodiments, the roofing material is one of (i) an asphaltic shingle, (ii) a non-asphaltic shingle, and (ii) a polymer-modified asphalt shingle. According to one embodiment, the roofing material is a roofing shingle that is one of (i) a single layer shingle or (ii) a laminated shingle having two or more layers.

In an embodiment, each roofing granule of the plurality of roofing granules has a density of 1 g/cm$^3$ to 3 g/cm$^3$. In an embodiment, each roofing granule of the plurality of roofing granules has a density of 1.2 g/cm$^3$ to 3 g/cm$^3$. In an embodiment, each roofing granule of the plurality of roofing granules has a density of 1.5 g/cm$^3$ to 3 g/cm$^3$. In an embodiment, each roofing granule of the plurality of roofing granules has a density of 1.6 g/cm$^3$ to 3 g/cm$^3$. In an embodiment, each roofing granule of the plurality of roofing granules has a density of 1.8 g/cm$^3$ to 3 g/cm$^3$. In an embodiment, each roofing granule of the plurality of roofing granules has a density of 2 g/cm$^3$ to 3 g/cm$^3$. In an embodiment, each roofing granule of the plurality of roofing granules has a density of 2.2 g/cm$^3$ to 3 g/cm$^3$. In an embodiment, each roofing granule of the plurality of roofing granules has a density of 2.5 g/cm$^3$ to 3 g/cm$^3$. In an embodiment, each roofing granule of the plurality of roofing granules has a density of 2.8 g/cm$^3$ to 3 g/cm$^3$. In an embodiment, each roofing granule of the plurality of roofing granules has a density of 1 g/cm$^3$ to 2.5 g/cm$^3$. In an embodiment, each roofing granule of the plurality of roofing granules has a density of 1.2 g/cm$^3$ to 2.5 g/cm$^3$. In an embodiment, each roofing granule of the plurality of roofing granules has a density of 1.5 g/cm$^3$ to 2.5 g/cm$^3$. In an embodiment, each roofing granule of the plurality of roofing granules has a density of 1.6 g/cm$^3$ to 2.5 g/cm$^3$. In an embodiment, each roofing granule of the plurality of roofing granules has a density of 1.8 g/cm$^3$ to 2.5 g/cm$^3$. In an embodiment, each roofing granule of the plurality of roofing granules has a density of 2 g/cm$^3$ to 2.5 g/cm$^3$. In an embodiment, each roofing granule of the plurality of roofing granules has a density of 2.2 g/cm$^3$ to 2.5 g/cm$^3$. In an embodiment, each roofing granule of the plurality of roofing granules has a density of 1 g/cm$^3$ to 2 g/cm$^3$. In an embodiment, each roofing granule of the plurality of roofing granules has a density of 1.2 g/cm$^3$ to 2 g/cm$^3$. In an embodiment, each roofing granule of the plurality of roofing granules has a density of 1.5 g/cm$^3$ to 2 g/cm$^3$. In an embodiment, each roofing granule of the plurality of roofing granules has a density of 1.6 g/cm$^3$ to 2 g/cm$^3$. In an embodiment, each roofing granule of the plurality of roofing granules has a density of 1.8 g/cm$^3$ to 2 g/cm$^3$. In an embodiment, each roofing granule of the plurality of roofing granules has a density of 1 g/cm$^3$ to 1.6 g/cm$^3$. In an embodiment, each roofing granule of the plurality of roofing granules has a density of 1.2 g/cm$^3$ to 1.6 g/cm$^3$. In an embodiment, each roofing granule of the plurality of roofing granules has a density of 1.5 g/cm$^3$ to 1.6 g/cm$^3$.

In an embodiment, the non-mineral based particles comprise a synthetic particle. In some embodiments, the non-mineral based particles comprise at least one of a thermoplastic polymer, filled polymers, filled rubbers, filled plastics, highly filled polymer particles, composite particles of non-mineral materials, such as a polymer-sand composite, a rubber particle, a recycled material, a wood filled polymer, a bio-based particle, a thermoset material, a fiber-reinforced polymer, and combinations thereof. According to one embodiment, the particles can be highly filled with mineral fillers, including, e.g., sands, stone fines, granule fines, calcium carbonates, clays, fly ashes, and combinations thereof. According to an embodiment, the particles can be filled with mineral fillers by up to 75% by weight.

In an embodiment, the non-mineral based particles can contain functional fillers to improve processability, impact resistance, fire resistance, UV resistance, UV blocking, oxidation resistance, color stability, algae resistance, and combinations thereof, as well as fillers able to remove and/or trap a targeted chemical compound (such as, e.g., NOx, $CO_2$, etc.). Also, according to an embodiment, the particles can have highly reflective pigments, such as, e.g., pigments comprising $TiO_2$, metal oxides, graphene, perylene, transitional metal oxides, metallic pigments, pearlescent pigments, thin film coated pigments, solar reflective colorants, solar reflective fillers, opacifiers, voids, or their combinations to increase the total solar reflectance of the particles.

According to an embodiment, the non-mineral based particles can be obtained via a number of processes, including, but not limited to, extrusion, co-extrusion, blending or mixing at elevated temperatures, or any agglomeration process to form the initial mass, followed by particle forming methods such as, e.g., crushing, impact-crushing, hammer mills, cryogenic crushing or grinding, roller mills, chopping or cutting after extrusion strand forming, injection molding, compression molding, encapsulations, and combinations thereof.

According to an embodiment, the non-mineral based particles can have other structures such as, e.g., a core-shell structure to have different layers that can provide different functionalities and/or to have a low-cost core covered with a durable, weatherable outer layer. Also, according to an embodiment, the non-mineral based particles can include a biocide or algaecide to help to control the roof algae growth and/or to maintain the aesthetics. Furthermore, according to an embodiment, the non-mineral based particles can have an adhesive promoter, a surface for promoting adhesion to asphalt, and/or a surface treated via plasma or flame or the like to promote its adhesion to an asphaltic coating.

According to an embodiment, the non-mineral based particles comprise one or more shapes, including, for example, round shapes, flat circles, squares, cylinders (including, e.g., flat cylinders, disk-shapes, rod shapes, and/or pancakes), flat rectangles (including, e.g., coasters), etc., and combinations thereof.

According to an embodiment, the non-mineral based particles have an aspect ratio, meaning a ratio between the smallest dimension to the largest dimension of the particles (e.g., a ratio of the thickness to the diameter of, for example, a disk-shaped particle and/or a ratio of the thickness to the length of, for example, a rod shaped particle), of from 1.5 to 50. According to another embodiment, the non-mineral based particles have an aspect ratio of from 2 to 50. According to an embodiment, the non-mineral based particles have an aspect ratio of from 3 to 50. According to an embodiment, the non-mineral based particles have an aspect ratio of from 5 to 50. According to an embodiment, the non-mineral based particles have an aspect ratio of from 10 to 50. According to an embodiment, the non-mineral based particles have an aspect ratio of from 15 to 50. According to an embodiment, the non-mineral based particles have an aspect ratio of from 20 to 50. According to an embodiment, the non-mineral based particles have an aspect ratio of from 25 to 50. According to an embodiment, the non-mineral based particles have an aspect ratio of from 30 to 50. According to an embodiment, the non-mineral based particles have an aspect ratio of from 40 to 50. According to an embodiment, the non-mineral based particles have an aspect ratio of from 1.5 to 40. According to an embodiment, the non-mineral based particles have an aspect ratio of from 2 to 40. According to an embodiment, the non-mineral based particles have an aspect ratio of from 3 to 40. According to an embodiment, the non-mineral based particles have an aspect ratio of from 5 to 40. According to an embodiment, the non-mineral based particles have an aspect ratio of from 10 to 40. According to an embodiment, the non-mineral based particles have an aspect ratio of from 15 to 40. According to an embodiment, the non-mineral based particles have an aspect ratio of from 20 to 40. According to an embodiment, the non-mineral based particles have an aspect ratio of from 25 to 40. According to an embodiment, the non-mineral based particles have an aspect ratio of from 30 to 40. According to an embodiment, the non-mineral based particles have an aspect ratio of from 1.5 to 30. According to an embodiment, the non-mineral based particles have an aspect ratio of from 2 to 30. According to an embodiment, the non-mineral based particles have an aspect ratio of from 3 to 30. According to an embodiment, the non-mineral based particles have an aspect ratio of from 5 to 30. According to an embodiment, the non-mineral based particles have an aspect ratio of from 10 to 30. According to an embodiment, the non-mineral based particles have an aspect ratio of from 15 to 30. According to an embodiment, the non-mineral based particles have an aspect ratio of from 20 to 30. According to an embodiment, the non-mineral based particles have an aspect ratio of from 25 to 30. According to an embodiment, the non-mineral based particles have an aspect ratio of from 1.5 to 25. According to an embodiment, the non-mineral based particles have an aspect ratio of from 2 to 25. According to an embodiment, the non-mineral based particles have an aspect ratio of from 3 to 25. According to an embodiment, the non-mineral based particles have an aspect ratio of from 5 to 25. According to an embodiment, the non-mineral based particles have an aspect ratio of from 10 to 25. According to an embodiment, the non-mineral based particles have an aspect ratio of from 15 to 25. According to an embodiment, the non-mineral based particles have an aspect ratio of from 20 to 25. According to an embodiment, the non-mineral based particles have an aspect ratio of from 1.5 to 20. According to an embodiment, the non-mineral based particles have an aspect ratio of from 2 to 20. According to an embodiment, the non-mineral based particles have an aspect ratio of from 3 to 20. According to an embodiment, the non-mineral based particles have an aspect ratio of from 5 to 20. According to an embodiment, the non-mineral based particles have an aspect ratio of from 10 to 20. According to an embodiment, the non-mineral based particles have an aspect ratio of from 15 to 20. According to an embodiment, the non-mineral based particles have an aspect ratio of from 1.5 to 15. According to an embodiment, the non-mineral based particles have an aspect ratio of from 2 to 15. According to an embodiment, the non-mineral based particles have an aspect ratio of from 3 to 15. According to an embodiment, the non-mineral based particles have an aspect ratio of from 5 to 15. According to an embodiment, the non-mineral based particles have an aspect ratio of from 10 to 15. According to an embodiment, the non-mineral based particles have an aspect ratio of from 1.5 to 10. According to an embodiment, the non-mineral based particles have an aspect ratio of from 2 to 10. According to an embodiment, the non-mineral based particles have an aspect ratio of from 3 to 10. According to an embodiment, the non-mineral based particles have an aspect ratio of from 5 to 10. According to an embodiment, the non-mineral based particles have an aspect ratio of from 1.5 to 5. According to an embodiment, the non-mineral based particles have an aspect ratio of from 2 to 5. According to an embodiment, the non-mineral based particles have an aspect ratio of from 3 to 5. According to an embodiment, the non-mineral based particles have an aspect ratio of from 1.5 to 3. According to an embodiment, the non-mineral based particles have an aspect ratio of from 2 to 3. According to an embodiment, the non-mineral based particles have an aspect ratio of from 1.5 to 2. According to an embodiment, the non-mineral based particles have an aspect ratio of from 1 to 1.

In an embodiment, the non-mineral based particles have a particle size of #8 US mesh to #60 US mesh. In an embodiment, the non-mineral based particles have a particle size of #8 US mesh to #50 US mesh. In an embodiment, the non-mineral based particles have a particle size of #8 US mesh to #40 US mesh. In an embodiment, the non-mineral based particles have a particle size of #8 US mesh to #30 US mesh. In an embodiment, the non-mineral based particles have a particle size of #8 US mesh to #20 US mesh. In an embodiment, the non-mineral based particles have a particle size of #8 US mesh to #10 US mesh. In an embodiment, the non-mineral based particles have a particle size of #10 US mesh to #60 US mesh. In an embodiment, the non-mineral based particles have a particle size of #10 US mesh to #50 US mesh. In an embodiment, the non-mineral based particles have a particle size of #10 US mesh to #40 US mesh. In an embodiment, the non-mineral based particles have a particle size of #10 US mesh to #30 US mesh. In an embodiment, the non-mineral based particles have a particle size of #10 US mesh to #20 US mesh. In an embodiment, the non-mineral based particles have a particle size of #20 US mesh to #60 US mesh. In an embodiment, the non-mineral based particles have a particle size of #20 US mesh to #50 US mesh. In an embodiment, the non-mineral based particles have a particle size of #20 US mesh to #40 US mesh. In an embodiment, the non-mineral based particles have a particle size of #20 US mesh to #30 US mesh. In an embodiment, the non-mineral based particles have a particle size of #30 US mesh to #60 US mesh. In an embodiment, the non-mineral based particles have a particle size of #30 US mesh to #50 US mesh. In an embodiment, the non-mineral based particles have a particle size of #30 US mesh to #40 US mesh. In an embodiment, the non-mineral based particles have a particle size of #40 US mesh to #60 US mesh. In an embodiment, the non-mineral based particles have a particle size of #40 US mesh to #50 US mesh. In an embodiment, the non-mineral based particles have a particle size of #50 US mesh to #60 US mesh.

In one embodiment, less than 50% by weight of the plurality of roofing granules have a particle size of greater than #100 US mesh. In an embodiment, less than 40% by weight of the plurality of roofing granules have a particle size of greater than #100 US mesh. In an embodiment, less than 30% by weight of the plurality of roofing granules have a particle size of greater than #100 US mesh. In an embodiment, less than 20% by weight of the plurality of roofing granules have a particle size of greater than #100 US mesh. In an embodiment, less than 10% by weight of the plurality of roofing granules have a particle size of greater than #100 US mesh. In an embodiment, less than 5% by weight of the plurality of roofing granules have a particle size of greater than #100 US mesh. In an embodiment, less than 1% by weight of the plurality of roofing granules have a particle size of greater than #100 US mesh.

In one embodiment, the roofing material exhibits a lower weight per thickness as compared to a roofing material prepared with roofing granules comprising a majority of mineral based particles.

In an embodiment, the roofing material exhibits a weight per thickness of 1 to 3 g/mil/ft$^2$. In an embodiment, the roofing material exhibits a weight per thickness of 1.2 to 3 g/mil/ft$^2$. In an embodiment, the roofing material exhibits a weight per thickness of 1.4 to 3 g/mil/ft$^2$. In an embodiment, the roofing material exhibits a weight per thickness of 1.5 to 3 g/mil/ft$^2$. In an embodiment, the roofing material exhibits a weight per thickness of 1.6 to 3 g/mil/ft$^2$. In an embodiment, the roofing material exhibits a weight per thickness of 1.8 to 3 g/mil/ft$^2$. In an embodiment, the roofing material exhibits a weight per thickness of 2 to 3 g/mil/ft$^2$. In an embodiment, the roofing material exhibits a weight per thickness of 2.2 to 3 g/mil/ft$^2$. In an embodiment, the roofing material exhibits a weight per thickness of 2.4 to 3 g/mil/ft$^2$. In an embodiment, the roofing material exhibits a weight per thickness of 2.5 to 3 g/mil/ft$^2$. In an embodiment, the roofing material exhibits a weight per thickness of 2.6 to 3 g/mil/ft$^2$. In an embodiment, the roofing material exhibits a weight per thickness of 2.8 to 3 g/mil/ft$^2$.

In an embodiment, the roofing material exhibits an improved staining resistance as compared to a roofing material prepared with roofing granules comprising a majority of mineral based particles.

In an embodiment, the roofing granules exhibit a total solar reflectance (TSR) of 0.2 to 0.8 according to ASTM C1549. In an embodiment, the roofing granules exhibit a total solar reflectance (TSR) of 0.3 to 0.8 according to ASTM C1549. In an embodiment, the roofing granules exhibit a total solar reflectance (TSR) of 0.4 to 0.8 according to ASTM C1549. In an embodiment, the roofing granules exhibit a total solar reflectance (TSR) of 0.5 to 0.8 according to ASTM C1549. In an embodiment, the roofing granules exhibit a total solar reflectance (TSR) of 0.6 to 0.8 according to ASTM C1549. In an embodiment, the roofing granules exhibit a total solar reflectance (TSR) of 0.7 to 0.8 according to ASTM C1549. In an embodiment, the roofing granules exhibit a total solar reflectance (TSR) of 0.2 to 0.7 according to ASTM C1549. In an embodiment, the roofing granules exhibit a total solar reflectance (TSR) of 0.3 to 0.7 according to ASTM C1549. In an embodiment, the roofing granules exhibit a total solar reflectance (TSR) of 0.4 to 0.7 according to ASTM C1549. In an embodiment, the roofing granules exhibit a total solar reflectance (TSR) of 0.5 to 0.7 according to ASTM C1549. In an embodiment, the roofing granules exhibit a total solar reflectance (TSR) of 0.6 to 0.7 according to ASTM C1549. In an embodiment, the roofing granules exhibit a total solar reflectance (TSR) of 0.2 to 0.6 according to ASTM C1549. In an embodiment, the roofing granules exhibit a total solar reflectance (TSR) of 0.3 to 0.6 according to ASTM C1549. In an embodiment, the roofing granules exhibit a total solar reflectance (TSR) of 0.4 to 0.6 according to ASTM C1549. In an embodiment, the roofing granules exhibit a total solar reflectance (TSR) of 0.5 to 0.6 according to ASTM C1549. In an embodiment, the roofing granules exhibit a total solar reflectance (TSR) of 0.2 to 0.5 according to ASTM C1549. In an embodiment, the roofing granules exhibit a total solar reflectance (TSR) of 0.3 to 0.5 according to ASTM C1549. In an embodiment, the roofing granules exhibit a total solar reflectance (TSR) of 0.4 to 0.5 according to ASTM C1549. In an embodiment, the roofing granules exhibit a total solar reflectance (TSR) of 0.2 to 0.4 according to ASTM C1549. In an embodiment, the roofing granules exhibit a total solar reflectance (TSR) of 0.3 to 0.4 according to ASTM C1549. In an embodiment, the roofing granules exhibit a total solar reflectance (TSR) of 0.2 to 0.3 according to ASTM C1549.

In one embodiment, the roofing granules exhibit a higher color saturation as compared to roofing granules comprising mineral based particles.

Another embodiment of this invention pertains to a method of preparing a roofing material. The method includes (a) obtaining a coated substrate, (b) obtaining a plurality of roofing granules, wherein the plurality of roofing granules comprises from 50% to 100% of unitary, uncoated, non-mineral based particles, and (c) applying the plurality of roofing granules to a surface of the coated substrate to form a roofing material.

In an embodiment, the step of applying the plurality of roofing granules to the surface of the coated substrate is conducted to achieve an average surface coverage amount of the roofing granules of greater than 95%. In an embodiment, the step of applying the plurality of roofing granules to the surface of the coated substrate is conducted to achieve an average surface coverage amount of the roofing granules of greater than 90%. In an embodiment, the step of applying the plurality of roofing granules to the surface of the coated substrate is conducted to achieve an average surface coverage amount of the roofing granules of greater than 85%. In an embodiment, the step of applying the plurality of roofing granules to the surface of the coated substrate is conducted to achieve an average surface coverage amount of the roofing granules of greater than 80%. In an embodiment, the step of applying the plurality of roofing granules to the surface of the coated substrate is conducted to achieve an average surface coverage amount of the roofing granules of greater than 75%. In an embodiment, the step of applying the plurality of roofing granules to the surface of the coated substrate is conducted to achieve an average surface coverage amount of the roofing granules of greater than 70%. In an embodiment, the step of applying the plurality of roofing granules to the surface of the coated substrate is conducted to achieve an average surface coverage amount of the roofing granules of greater than 65%. In an embodiment, the step of applying the plurality of roofing granules to the surface of the coated substrate is conducted to achieve an average surface coverage amount of the roofing granules of greater than 60%. In an embodiment, the step of applying the plurality of roofing granules to the surface of the coated substrate is conducted to achieve an average surface coverage amount of the roofing granules of greater than 55%. In an embodiment, the step of applying the plurality of roofing granules to the surface of the coated substrate is conducted to achieve an average surface coverage amount of the roofing granules of greater than 50%.

In an embodiment, asphaltic shingles with reduced weight can be obtained by using non-mineral based roofing granules according to embodiments of the disclosure as the surfacing media to reduce the weight of the shingle. Typically, mineral-based roofing granules have a density in a range exceeding 2.5 g/cm$^3$ and constitute a significant part of the total shingle weight. According to embodiments of this disclosure, by using non-mineral based roofing granules as the surfacing media, the weight of the shingles can be reduced. The shingle(s) with lighter weight can have benefits of being easier to handle and install, easier to carry to the job site, and lowered transportation cost.

According to an embodiment, the non-mineral based roofing granules or particles have a high UV opacity to protect the asphaltic coating of the substrate underneath, and have the durability for long term outdoor exposure required for roofing applications.

According to an embodiment, the non-mineral based roofing granules or particles can be applied to molten asphalt in a moving web via gravity feed, or another system, including, e.g., a high speed granule system which does not rely on gravity to apply the granules during a shingle manufacturing process to obtain shingles with a lighter weight. According to another embodiment, the non-mineral based roofing granules or particles can be applied to the molten asphalt surface via equipment that is designed to apply particles onto a moving web in a precise manner, such as, e.g., a high-speed particle applicator, electrostatic deposition, particle spraying, and combinations thereof. According to an embodiment, the non-mineral based roofing granules or particles can be applied throughout the entire shingle surface or in certain areas, such as in the upper exposure area, to form the shingles with desirable properties while reducing the potential cost impact. According to an embodiment, the non-mineral based roofing granules or particles can be applied to the back of the shingles to increase the shingle thickness, while keeping the weight of the shingle lowered. According to another embodiment, the non-mineral based roofing granules or particles may be combined with mineral-based roofing granules to form blends that may deliver unique textures and/or aesthetics on the shingle surface.

According to an embodiment, the synthetic or non-mineral based roofing granules with increased solar reflectance can be obtained by using non-mineral based particles having suitable sizes and geometries that can result in a high surface coverage over an asphaltic shingle surface. According to another embodiment, the non-mineral based roofing granules or particles can contain solar reflective pigments and/or additives to provide high solar reflectivity while maintaining desirable aesthetics.

In another embodiment, roofing materials, e.g., shingles, with improved staining resistance can be obtained by applying the non-mineral based roofing granules in the exposure area or the upper surface of the shingles. The improved staining resistance can be achieved by using non-mineral based granules or particles that have much less surface porosity and/or lower surface energy or lower affinity to prevent the spreading of oils migrating from the asphaltic substrates. Mineral-based roofing granules may have rough surfaces and surface porosity from crushing of the mineral rock base that can readily absorb asphaltic oils. In addition, the mineral surfaces may have very high surface energy, such that the asphaltic oils will be absorbed to lower the surface energy, which thereby results in staining. To reduce these effects and the staining, mineral-based roofing granules may be treated with siliconate coatings to seal off the surface porosity and to lower the surface energetics for reducing its staining potential. By using the non-mineral based granules or particles according to embodiments of this disclosure, the staining potential can be reduced by such granules or particles that contain low surface porosity and/or low surface energy without additional surface treatments. In addition, mineral-based roofing granules may be blended with mineral oils or slate oils to help reduce the dust formation during transportation, which can lead to color change as the shingles made with such granules are weathered outdoors. However, by using the non-mineral based granules or particles according to embodiments of this disclosure as the roofing surfacers, there is no need to apply mineral oils or slate oils as dust controlling agents.

In another embodiment, roofing materials (e.g., shingles) with improved color saturations or improved gloss appearance can be obtained by using the non-mineral based granules on the outer surface or the exposure areas. Typical mineral-based roofing granules are coated with pigmented metal-silicate coatings that inefficiently cover the mineral surfaces, which result in granule colors that are far from the saturated color space. Also, the mineral surfaces are relatively rough due to crevices and/or pores that are formed from crushing and fracturing during the granule making process, which can lead to dull surfaces with relatively low gloss surface characteristics. This is especially visible along the cut edge of shingles where the granule coatings were crushed by the cutting knife to result in an "edge line" of granule showing its base mineral color. However, by using the non-mineral based granules or particles according to embodiments of this disclosure as the surfacing media, the color can be more evenly provided throughout the particles for reaching the saturated color and the color will be maintained even if the particles are severed. Also, according to an embodiment, the surface of the non-mineral based particles can have a high gloss for achieving desirable aesthetics in matching other roofing elements having high gloss surfaces.

According to one embodiment, the particles can have a greater affinity to the substrate materials or coatings, such that the particles will have low rub loss and/or reduced granule loss over time.

According to an embodiment, the particles can be transported or processed during a typical shingle making process without generating air-borne dust, as in the case of mineral-based roofing granules, such that the measure for dust control or additional dust handling steps can be reduced or eliminated.

According to an embodiment, the particles can improve the impact resistance of the shingle and/or membranes by absorbing the impact energy via plasticity or viscoelastic properties of the polymeric materials, or via a collapsible structural of the particles, including, e.g., a core/shell construction.

According to another embodiment, the particles can have a surface texture to enhance the aesthetics of the finished roof surfaces and/or surface treatments to enhance adhesions to substrates.

According to an embodiment, the non-mineral based particles or granules and/or a roofing material prepared from such non-mineral based particles or granules can exhibit improved algae resistance as compared to, e.g., mineral based particles or granules and/or a roofing material prepared with mineral based particles or granules.

EXAMPLES

Specific embodiments of the invention will now be demonstrated by reference to the following examples. It should be understood that these examples are disclosed by way of illustrating the invention and should not be taken in any way to limit the scope of the present invention.

Example 1

Samples of synthetic, non-mineral based particles suitable for outdoor exposures were obtained from a commercially available source and were compared to existing mineral-based roofing granules used for roofing shingles. Their colors were measured using a colorimeter (HunterLab XE colorimeter using D65 illumination and 10° observer) and are listed in the Table shown in FIG. 2 for direct comparison. Also, their total solar reflectance (TSR) was measured following ASTM C1549 using a D&S solar reflectometer (1.5 air mass). (See measured TSR data values shown in the Table of FIG. 2.)

The data shows that the non-mineral based particles can have a similar color space with an increased solar reflectance. For example, as shown in the data of the Table of FIG. 2, the mineral-based granule entitled "Light Black" has a 0.1 TSR, whereas the closely matched color of the non-mineral based granule entitled "DARK GRAY" has a 0.2 TSR. Also, as shown by the data for this Example, the non-mineral based particles can result in a higher color strength or a higher color saturation. (See, e.g., the E* value in the data of the Table of FIG. 2, which is a measure of the color space from the center of the color sphere where the outer surface represents the most saturated color.) For example, as shown in the data of the Table of FIG. 2, the highest E* value achieved by the mineral based granules was about 77 (see, e.g., mineral-based granules entitled "White"), whereas the highest E* value achieved by the non-mineral based particles was greater than 95 (see, e.g., synthetic granules entitled "White 299").

Example 2

Figure 3:
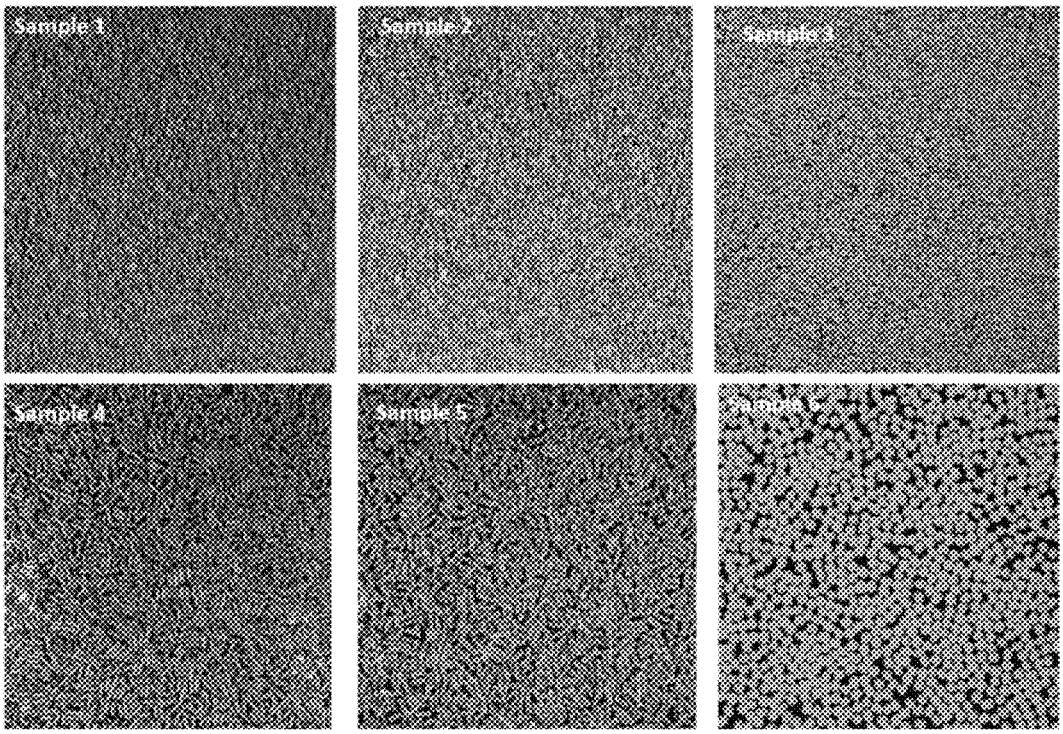
FIG. 3 is a photograph of three different granule colors for both mineral-based roofing granules and non-mineral based roofing granules according to embodiments of the invention.

Asphaltic shingle samples covered by either mineral-based granules or non-mineral based granules were made and compared in the following manner. Approximately 200 grams of mineral based granules were obtained and applied onto a 4"×4" asphalt substrate by gravity feed to fully cover the entire surface of the substrate, followed by pressing using a 25-lb roller having diameter of 6". After the pressing, excessive granules were removed to form the shingle surface. The same procedure was repeated for the non-mineral based granules to obtain shingle samples. Three granule colors were selected in each granule category (i.e., mineral-based granules and non-mineral based granules) (see, e.g., FIG. 3) and were made into the shingle form of a 4"×4" size as described above. The resultant shingle samples had a uniform granulated surface. The color of each of the prepared shingle samples, as well as their TSR values were measured. These measured values are shown in the Table of FIG. 4.

As can be seen by the data in the Table shown in FIG. 4, the shingle samples prepared with non-mineral based granules were found to have a lower weight per thickness per area as compared to the shingle samples prepared with mineral-based particles. For example, the mineral-based granulated shingle samples had a weight per thickness per area ranging from about 2.3 g/mil/ft$^2$ to about 2.6 g/mil/ft$^2$, whereas the non-mineral based granulated shingle samples had a weight per thickness per area range of only about 1.5 g/mil/ft$^2$ to 1.9 g/mil/ft$^2$. Thus, this example illustrates that shingle samples prepared with non-mineral based granules result in much less weight per roofing square, or thicker shingles at the same weight. The data also shows that the shingle samples made with non-mineral based granules have significantly higher TSR values, as compared to those made with mineral-based granules. (See, e.g., TSR values shown in the Table of FIG. 4.)

Example 3

Shingle samples were made using the same procedure as described in Example 2 above to test their staining resistance. For the mineral-based roofing granules, the roofing granule entitled "1-760" was selected in "white color". For the non-mineral based granules, the roofing granule entitled "RV Grey" was selected. The non-mineral based granules ("RV Grey") were also selected in the white color space and used for comparing with the selected mineral-based roofing granules ("I-760"). The prepared shingle samples were then tested for their staining resistance by placing the samples in a forced-air oven at 175° F. for 24 hours. The samples' color before and after the staining test were measured. The results are shown in the Table of FIG. 5 and also shown in FIG. 6 for visual comparison.

Figures 5, 6:
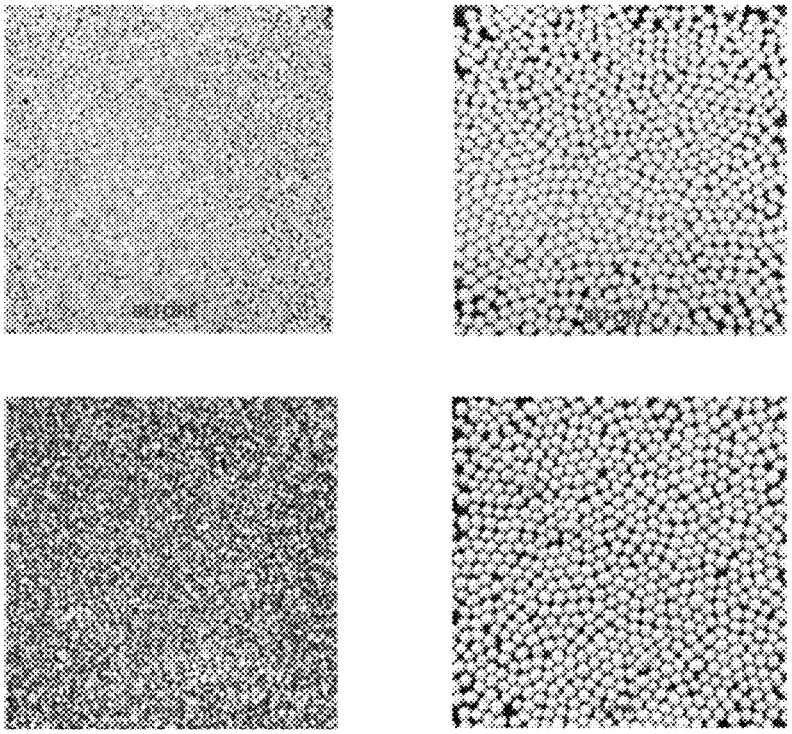
FIG. 5 is a table illustrating color values and staining index values ($\Delta E^*$) of mineral-based roofing granules as compared to synthetic or non-mineral based roofing granules according to embodiments of the invention.
FIG. 6 is a photograph illustrating the staining resistance of shingle samples prepared with mineral-based roofing granules as compared to synthetic or non-mineral based roofing granules according to embodiments of the invention.

As can be seen from the data in the Table of FIG. 5, as well as the visual results of FIG. 6, the shingle sample prepared with mineral-based granules showed a significant darkening effect with a Delta E value of 3.3 due to the staining from the asphaltic substrate, whereas the shingle sample prepared with non-mineral based granules was not affected by asphalt staining and had a minimum change in color with a Delta E value of 0.4. These results can also be seen in FIG. 6, where the color of the shingle sample prepared with mineral-based particles is significantly changed after the staining test, which is undesirable from an aesthetic point of view, as compared to the color of the shingle sample prepared with non-mineral based particles.

Although the invention has been described in certain specific exemplary embodiments, many additional modifications and variations would be apparent to those skilled in the art in light of this disclosure. It is, therefore, to be understood that this invention may be practiced otherwise than as specifically described. Thus, the exemplary embodiments of the invention should be considered in all respects to be illustrative and not restrictive, and the scope of the invention to be determined by any claims supportable by this application and the equivalents thereof, rather than by the foregoing description.

We claim:

1. A roofing material comprising:

(a) a coated substrate having (i) a top surface, (ii) a back surface, (iii) a headlap portion, and (iv) a buttlap portion having a plurality of tabs; and (b) a plurality of roofing granules applied to the top surface of the coated substrate, wherein the plurality of roofing granules comprises from 50% to 100% of unitary, uncoated, non-mineral based particles, the non-mineral based particles comprising at least one of a thermoplastic polymer, filled polymers, filled rubbers, filled plastics, a polymer-sand composite, a rubber particle, a wood filled polymer, a bio-based particle, a thermoset material, a fiber-reinforced polymer, and combinations thereof, wherein the plurality of roofing granules that are applied to the top surface are applied at an average surface coverage amount of the roofing granules of greater than 80%, with the plurality of roofing granules applied to the top surface being exposed across the buttlap portion, wherein the roofing material is configured to be installed on a roof to form a roofing system, and wherein, when the roofing material is installed on the roof to form the roofing system, the plurality of roofing granules forms an exposed surface of the roofing system.

2. The roofing material according to claim 1, wherein the substrate comprises one of a fiberglass mat, a polyester mat, a scrim, a coated scrim, or a combination thereof.

3. The roofing material according to claim 1, wherein the roofing material is one of a roofing shingle and a roofing tile.

4. The roofing material according to claim 1, wherein the roofing material is one of (i) an asphaltic shingle, (ii) a non-asphaltic shingle, and (ii) a polymer-modified asphalt shingle.

5. The roofing material according to claim 1, wherein each roofing granule of the plurality of roofing granules has a density of 1.2 g/cm$^3$ to 2.5 g/cm$^3$.

6. The roofing material according to claim 1, wherein the non-mineral based particles comprise a synthetic particle.

7. The roofing material according to claim 1, wherein the at least one of a thermoplastic polymer, filled polymers, filled rubbers, filled plastics, a polymer-sand composite, a rubber particle, a wood filled polymer, a bio-based particle, a thermoset material, a fiber-reinforced polymer, and combinations thereof comprises a recycled material.

8. The roofing material according to claim 1, wherein the non-mineral based particles have an aspect ratio of from 1.5 to 50.

9. The roofing material according to claim 1, wherein the non-mineral based particles have a particle size of from #8 US mesh to #60 US mesh.

10. The roofing material according to claim 1, wherein less than 1% by weight of the plurality of roofing granules have a particle size of greater than #100 US mesh.

11. The roofing material according to claim 1, wherein the roofing material exhibits a lower weight per thickness as compared to a roofing material prepared with roofing granules comprising mineral based particles.

12. The roofing material according to claim 1, wherein the roofing material exhibits a weight per thickness of from 0.17 to 0.21 g/mil.

13. The roofing material according to claim 1, wherein the roofing material exhibits an improved staining resistance as compared to a roofing material prepared with roofing granules comprising mineral based particles.

14. The roofing material according to claim 1, wherein the roofing granules exhibit a total solar reflectance (TSR) of from 0.2 to 0.8 according to ASTM C1549.

15. The roofing material according to claim 1, wherein the roofing granules exhibit a higher color saturation as compared to roofing granules comprising mineral based particles.

16. A method of preparing a roofing material, the method comprising:

(a) obtaining a coated substrate having (i) a top surface, (ii) a back surface, (iii) a headlap portion, and (iv) a buttlap portion having a plurality of tabs;

(b) obtaining a plurality of roofing granules, wherein the plurality of roofing granules comprises from 50% to 100% of unitary, uncoated, non-mineral based particles, the non-mineral based particles comprising at least one of a thermoplastic polymer, filled polymers, filled rubbers, filled plastics, a polymer-sand composite, a rubber particle, a wood filled polymer, a bio-based particle, a thermoset material, a fiber-reinforced polymer, and combinations thereof; and (c) applying the plurality of roofing granules to the top surface of the coated substrate to form a roofing material, wherein the applying the plurality of roofing granules to the top surface of the coated substrate is conducted to achieve an average surface coverage amount of the roofing granules of greater than 80%, with the plurality of roofing granules applied to the top surface being exposed across the buttlap portion, wherein the roofing material is configured to be installed on a roof to form a roofing system, and wherein, when the roofing material is installed on the roof to form the roofing system, the plurality of roofing granules forms an exposed surface of the roofing system.

17. The method according to claim 16, wherein the substrate comprises one of a fiberglass mat, a polyester mat, a scrim, a coated scrim, or a combination thereof.

18. The method according to claim 16, wherein each roofing granule of the plurality of roofing granules has a density of 1.2 g/cm$^3$ to 2.5 g/cm$^3$.

19. The method according to claim 16, wherein the non-mineral based particles comprise a synthetic particle.

20. The method according to claim 16, wherein the at least one of a thermoplastic polymer, filled polymers, filled rubbers, filled plastics, a polymer-sand composite, a rubber particle, a wood filled polymer, a bio-based particle, a thermoset material, a fiber-reinforced polymer, and combinations thereof comprises a recycled material.

* * * * *